United States Patent [19]

Allen

[11] 4,171,999

[45] Oct. 23, 1979

[54] METHOD OF FABRICATING A TANK BY JOINING WALL SECTIONS WITH FIBER REINFORCED JOINER PANELS

[76] Inventor: John D. Allen, 5005 Zahm Rd., Belding, Mich. 48809

[21] Appl. No.: 881,412

[22] Filed: Feb. 27, 1978

Related U.S. Application Data

[62] Division of Ser. No. 746,465, Dec. 1, 1976, Pat. No. 4,112,644.

[51] Int. Cl.[2] ..... B65D 7/02; B32B 31/00

[52] U.S. Cl. ..... 156/69; 52/245; 52/585; 156/92; 156/174; 156/182; 156/293

[58] Field of Search ..... 156/69, 91, 92, 166, 156/174, 182, 242, 296, 264, 293, 172, 173, 175; 220/1 B, 4 R, 4 C, 4 D, 75, 76, 80, 83, DIG. 23; 52/79.1, 79.3, 79.9, 248, 474, 245, 585, 249; 29/467; 264/258, 257, 137

[56] References Cited

U.S. PATENT DOCUMENTS

| | | | |
|---|---|---|---|
| 2,074,592 | 3/1937 | Rowell | 52/248 |
| 2,242,614 | 5/1941 | Miesen | 52/245 |
| 2,729,268 | 1/1956 | Broughton et al. | 156/425 |
| 3,143,306 | 8/1964 | Dijkmans et al. | 242/7 |
| 3,323,265 | 6/1967 | Petersen | 52/248 |
| 3,537,938 | 11/1970 | Clements | 156/173 |
| 3,843,429 | 10/1974 | Jessup | 156/425 |
| 3,902,290 | 9/1975 | Marquet | 52/249 |
| 4,002,261 | 1/1977 | Litchfield | 220/83 |
| 4,036,390 | 7/1977 | Morse | 220/83 |

*Primary Examiner*—Michael W. Ball

*Attorney, Agent, or Firm*—Price, Heneveld, Huizenga & Cooper

[57] ABSTRACT

Assembly of a fiber reinforced resin tank includes joining a plurality of prefabricted arcuate wall panel sections by elongated joiner panels extending along the vertical seams between adjacent wall sections to form the perimeter of a cylindrical tank. The wall sections have a plurality of openings adjacent the vertical sides and the joiner panels have columns of transversely spaced pairs of protrusions for coupling with the openings in adjacent panel sections. The joiner panel is able to pass circumferential hoop stress from one panel section to an adjacent panel section by providing effective clamping between the two panels through the use of continuous filament and/or geometrically oriented glass or other fibers placed into a hooked shape so the fibers extend between each pair of spaced protrusions and curve into the protrusions so the fibers extend along the protrusions. Additionally, the wall sections include criss-crossing diagonal fibers so there are crossing fibers between the openings of the wall section and the vertical edge of the wall section thereby preventing a force applied by the protrusion in the opening from tearing the wall section.

6 Claims, 15 Drawing Figures

METHOD OF FABRICATING A TANK BY JOINING WALL SECTIONS WITH FIBER REINFORCED JOINER PANELS

This is a division of application Ser. No. 746,465, filed Dec. 1, 1976, now U.S. Pat. No. 4,112,644.

BACKGROUND OF THE INVENTION

This invention relates to fiber reinforced tank structures and to a method of fabricating such tanks.

Filament wound fiberglass tanks have been fabricated in accordance with the prior art by forming the shell of the tank on a full size mandrel in a fabrication shop under controlled conditions and then shipping the tank to the site where it is to be installed. Such an approach has inherent site limitations because of the need for a full size mandrel and for shipping the fabricated tanks. For example, tanks larger than 12 feet in diameter and longer than 50 feet are difficult to transport.

On site fabrication of fiber reinforced resin tanks has also been practiced in the prior art. For example, see U.S. Pat. No. 3,470,656 issued to H. R. Clements. While the problem of transporting a large tank is eliminated, transportation of the men and equipment to fabricate the tank is required. Fabrication of such a tank is a relatively skilled job and typically such skills are not found at the installation site. Further, fabrication of the tank must take place under relatively controlled conditions. For example, the temperature must be above a certain minimum and there cannot be any form of precipitation during fabrication of the tank. Such requirements typically necessitate the building of temporary structures enclosing the location of the tank to be fabricated. The structure of such an enclosure is complicated by the fact that it has to be heated and because of the evolution of large quantities of various resin and solvent vapors during the fiberglass winding operation necessitating extensive ventilation which adds to the difficulty of maintaining a heated enclosure.

As a result, the expenses of on site fabrication include transporting trained men and supervisors to the installation location, feeding and housing them at the installation location and the capital cost of temporary buildings, heating equipment, winding equipment, scaffolding, trucks and tools. Additionally, there is no way to build for stock or schedule the rapid erection of tanks at one site. Further, when multiple tank installations are desired, the tanks may not be able to be placed as closely together as desired because of the need to leave sufficient space between tanks for the operation of the field winding equipment.

The prior art also teaches prefabrication of components of storage tanks, shipping the components to the location of the installation and assembly of the components there. Fabrication of individual panels is taught in U.S. Pat. No. 3,143,306 issued to M. J. Dijkmans et al. However, typical assembly techniques have had substantial disadvantages which are often tolerated because of the need for sufficient circumferential or "hoop" strength in a filled tank. For example, one assembly technique requires supporting the prefabricated panels on a temporary structure and then continuously winding a filament around the entire tank. Such a technique is taught in U.S. Pat. No. 3,843,429 issued to W. B. Jessup. Clearly, many of the disadvantages of complete on site fabrication of the tank are present in such a system. U.S. Pat. No. 2,729,268 issued to D. C. Broughton et al. teaches assembling a cylindrically shaped mandrel on the trailer of a truck and winding on the mandrel a fiber reinforcement impregnated with a resin. After the resin has cured, the mandrel is disassembled and the shell pivoted upwardly from the trailer and tilted into position on a foundation. Clearly, specialized equipment is required and the size of the tank is limited by the size of the equipment to fabricate the entire tank. Another known method of assembling prefabricated sections includes wrapping the outside of a partially completed tank with steel cable. The steel cable is used so the final structure has sufficient strength to withstand the hoop stress developed in a filled tank. The method is disadvantageous because the fiberglass and the steel neither expand nor contract at the same rate upon temperature changes. Further, the cables have little or no resistance to the effects of spilled corrosive liquids. Finally, such an assembly technique produces a finished product with an uneven surface which is not easily cleaned. For example, a structure taught in U.S. Pat. No. 2,074,592 issued to F. F. Rowell used building blocks arranged one upon the other to form staves which are held together by means of tensioned hoops encircling the blocks upon the exterior thereof. These are among the deficiencies of existing storage tank fabrication systems this invention overcomes.

SUMMARY OF THE INVENTION

This invention provides a fiber reinforced resin tank larger than can be factory built and transported to the point of use. Sections of an easily transportable size are prefabricated and then shipped to the point of use for assembly. The sections include reinforcing fibers to provide sufficient hoop strength. The circumference of the tank is formed by a plurality of arcuate wall panel sections having coupling openings along the vertical edges of the wall sections. Elongated joiner panels having pairs of transversely spaced protrusions for engaging the openings in the wall sections and coupling the wall sections into a component perimeter.

More particularly, pairs of transversely spaced protrusions extend outwardly from a panel body and, advantageously, are spaced along the length of the joiner panel. Advantageously, filament fibers extend in the panel body between each one in the pair of spaced protrusions and extend further into and along the protrusions thus forming a generally U-shaped configuration for coupling a force applied to one protrusion to the other protrusion. As a result, a hoop force around the perimeter of the storage tank is coupled from an arcuate wall section to one of the protrusions of a pair, then to the other protrusion of the pair, then to an adjacent wall section and so on around the storage tank. The reinforcing fibers included in this path are sufficiently strong to withstand the hoop force of a filled storage tank.

An embodiment of this invention provides for relatively simple assembly at the point of use of a tank larger than could be ordinarily shipped. Prefabricated sections are built in a shop under ideal conditions thus eliminating the need for extensive fabrication at the point of use under more difficult conditions and involving higher fabrication cost. The factory tooling can be designed for continuous production, can be more sophisticated and can produce a better tank surface finish than is usually found in a field fabricated tank. The cost of the tanks is reduced because shop labor and overhead can be expected to be less expensive than labor performed in the field. Tanks can be built for stock or can be built in advance of required erection schedules so the time spent from order to finish can be reduced. The field assembly of a tank in accordance with an embodiment of this invention requires limited skills so the work can be performed by more readily available workmen. Further, since the high cost of ownership of a number of a field winding installations is eliminated, several tank at one site, or multiple installations at widely separated sites can be erected simultaneously. On multiple tank jobs, tanks can be placed much closer together because the clearance for the field winding equipment is not required. This particular modular construction further permits a section of a tank to be replaced should it become damaged in use. Although repair of prior art tanks is possible, it is typically achieved at a greater cost. Similarly, incorporation of side wall manholes, inlets, outlets or other accessories can be accomplished eiter as the tank is produced in the factory, at the installation site, or as these items may be needed at a future date.

DETAILED DESCRIPTION OF THE PREFERRED EMBODIMENT

Figure 1:
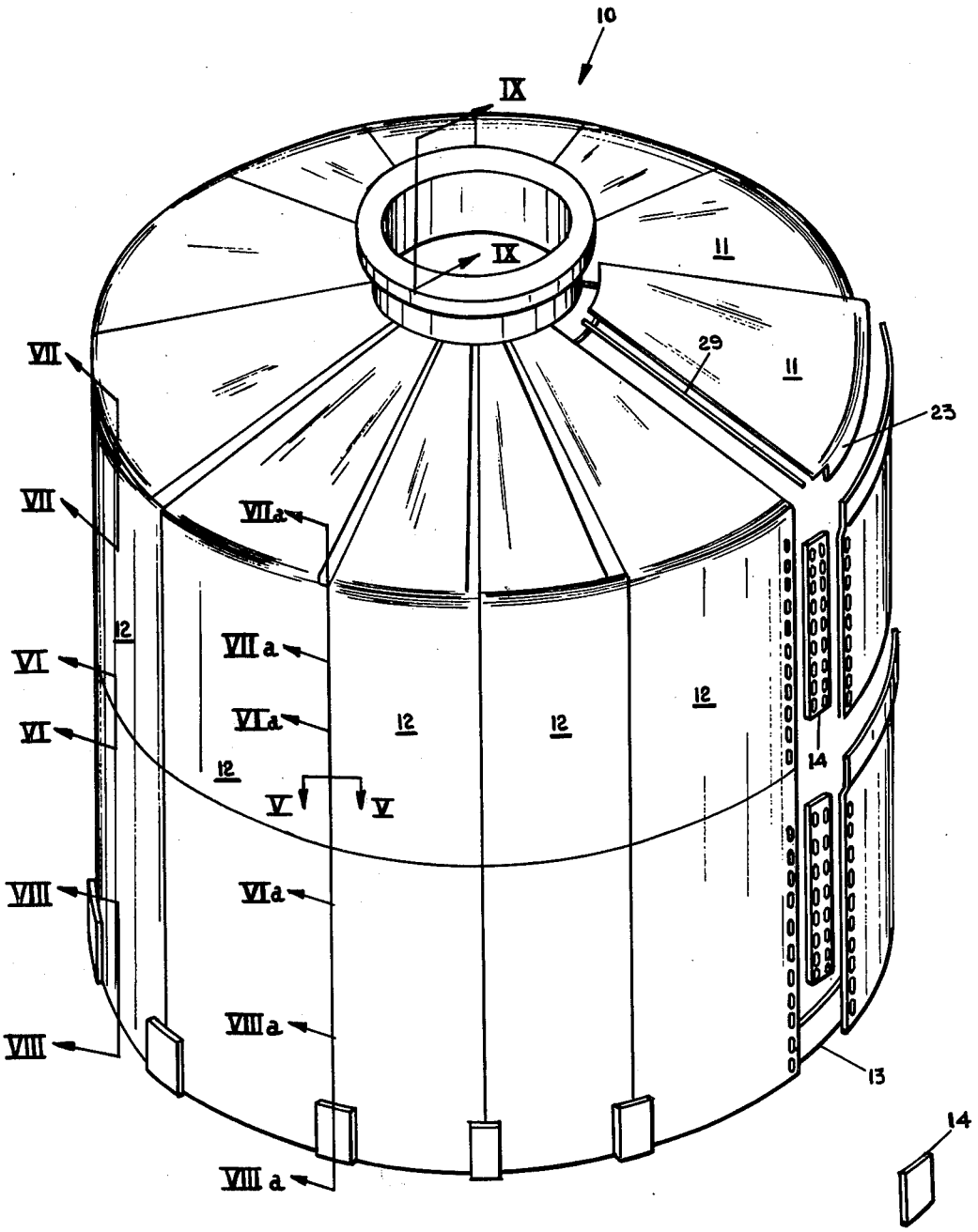
FIG. 1 is a perspective view, partially exploded, of a tank in accordance with an embodiment of this invention.
Figure 7:
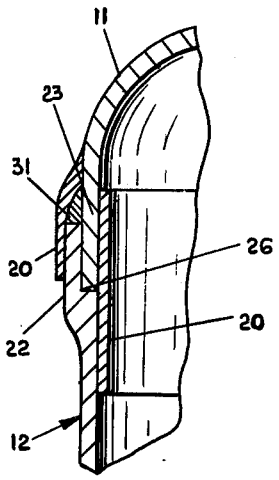
FIG. 7 is a cross section view taken along section line VII—VII of FIG. 1 showing the joint between the top vertical wall section and the pie-shaped top section.
Figure 7A:
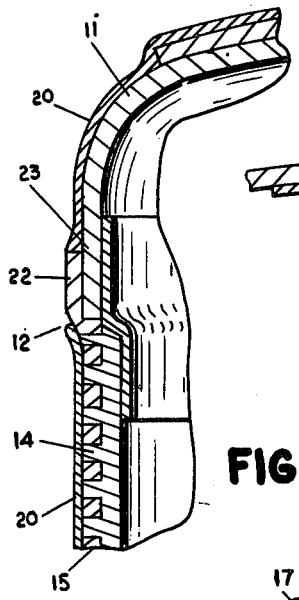
FIG. 7*a* is a cross section view taken along section line VII*a*–VII*a* of FIG. 1 showing the joint between the top and vertical section and the pie-shaped top section at a joiner panel.
Figure 2:
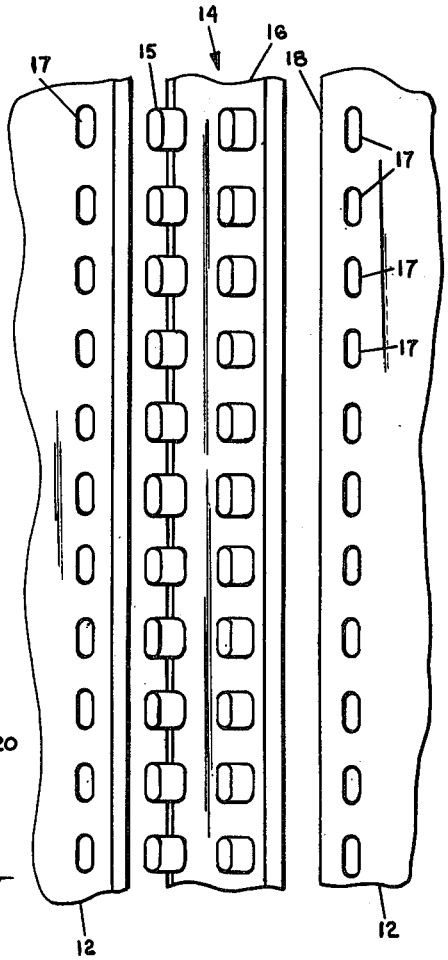
FIG. 2 is an enlarged, exploded perspective view of a vertical joint between two arcuate wall panel sections and a joiner panel for coupling the two wall sections.
Figure 8:
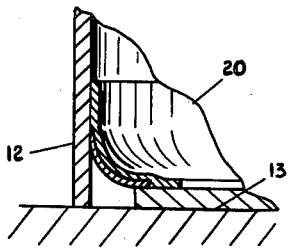
FIG. 8 is a cross section taken along section line VIII—VIII of FIG. 1 showing the joint between the bottom section and the bottom of the arcuate wall section.
Figure 8A:
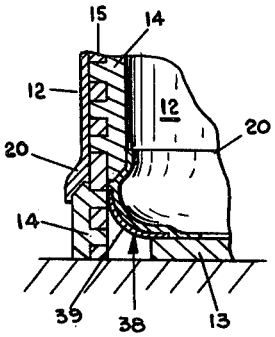
FIG. 8*a* is a cross section view taken along section line VIII*a*–VIII*a* of FIG. 1 showing the joint between the bottom section and the bottom of the arcuate wall section at a joiner panel.
Figure 5:
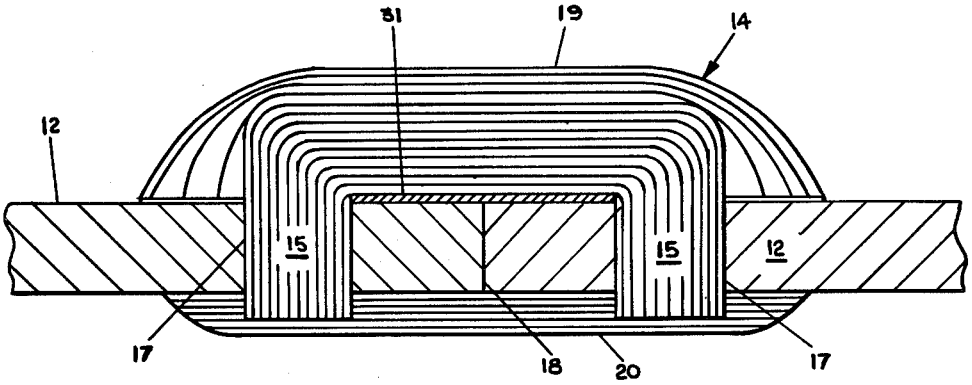
FIG. 5 is a cross section view taken along section line V—V of FIG. 1 showing a joiner panel connecting two arcuate wall sections.
Figure 3:
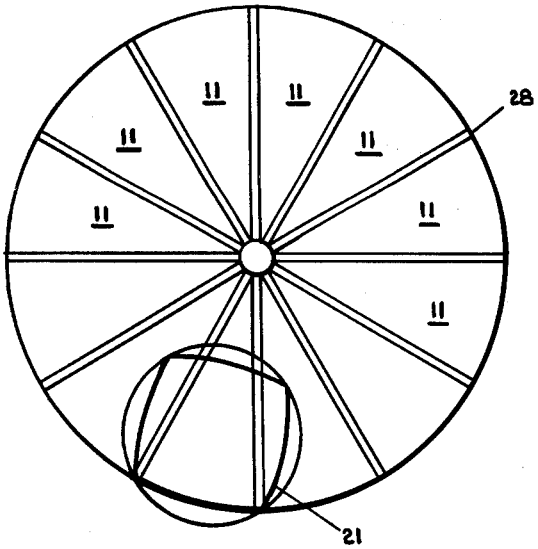
FIG. 3 is a top plan view of an assembled storage tank showing the pie-shaped roof sections and a superimposed sketch of an outline of a mandrel showing the relationship between an arcuate wall section and the mandrel from which the wall sections are constructed.

Referring to FIG. 1, a fiberglass tank 10 is assembled from prefabricated components including a pie-shaped top section 11, an arcuate wall panel section 12, a bottom section 13 and a joiner panel 14. As shown in FIG. 3, 12 top sections 11 are joined to form a conical tank top. Analogously, 12 side panel sections 12, or as sometimes referred to herein wall sections 12, are joined to form the cylindrical side of tank 10. Advantageously, the size of sections 11 and 12 is the largest size easily transported, thus keeping the number of sections 11 and 12 to a minimum which number can vary from the 12 sections shown. The joints between top sections 11 and wall sections 12 can be, for example, a bell and spigot joint as shown in FIGS. 7 and 7*a*. Adjacent wall sections 12 are joined by joiner panels 14 which have pairs of protrusions 15 extending outward from a body 16 for engaging openings 17 along the edges of side panel sections 12 (FIGS. 2 and 5). The perimeter of bottom section 13 can curve upward and abuts against the lower inside portion of side panel sections 12. Alternatively, as shown in FIGS. 8 and 8*a*, the perimeter of bottom section 13 is flat and an additional elongated connecting member 38 extends between wall section 12 and bottom section 13. The joints between the various sections of tank 10 are sealed by filler such as isophthalic catalyzed filler, and, if desired for additional strength, layers of fiberglass fabric and resin.

Figure 4:
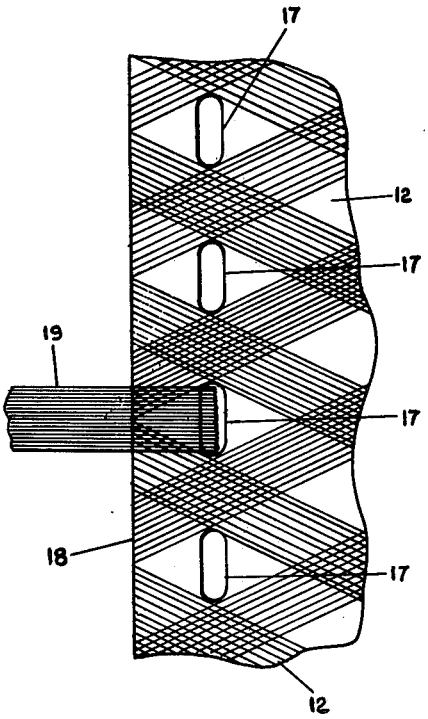
FIG. 4 is an enlarged back elevation view of the side of an arcuate panel section with criss-crossing filaments and the filaments in a portion of a joiner panel.

Side panel sections 12 have an arcuate shape corresponding to the curvature of the perimeter of tank 10 so the top and bottom edges of each section 12 are curved in a single horizontal plane and the sides are vertical straight lines. Along the length of each vertical side of side panel section 12, spaced from the edge and in a single column, are openings 17. As shown in FIG. 4, the openings are oblong, but the shape of the opening can be round, square, rectangular or otherwise as long as protrusion 15 fits snugly within opening 17. Opening 17 can be, for example, ¾" wide by 2" long, spaced 2" apart and placed 1" from an edge 18 of wall section 12. FIG. 4 also shows the winding pattern of reinforcing continuous and/or geometrically oriented filaments of fiberglass to be a criss-cross pattern having diagonally intersecting filaments across the face of side panel section 12. A plurality of shorter filaments can be oriented so the longitudinal axes are generally parallel to provide the desired load carrying strength. As a result of the criss-cross pattern, the reinforcing filaments intersect between openings 17 and edge 18 of panel section 12 and tend to resist the shear effect of a force applied between openings 17 and edge 18. As shown in FIG. 7, the top edge of panel section 12 has a transversely offset longitudinal ridge 22 thereby forming an angled pocket 26 bounded on the side by ridge 22 and on the bottom by the remainder of panel section 12. Pocket 26 is suited for receiving the bottom edge of top section 11 or the bottom edge of another panel section 12 which would be the case when the side of tank 10 includes two or more horizontal rows of panel sections 12.

Referring to FIG. 2, joiner panel 14 has a generally planar elongated body 16 with two columns of transversely spaced and paired protrusions 17. Protrusions 17 are longitudinally spaced the same distance that openings 17 are longitudinally spaced. The transverse spacing of protrusions 17, within each pair, is the distance from an opening 17 in one panel section 12 to a horizontally aligned opening 17 in an adjacent panel 12 when the two panels are positioned for assembly.

Referring to FIG. 5, continuous fiberglass filaments 19 extend transversely across body 16 between protrusions 15 and extend into each protrusion 15 to the extremity of protrusion 15. As a result, filaments 19 have a generally U-shape. It is within the scope of this invention to use geometrically oriented filaments which are shorter than the length of the U-shape. These shorter filaments or fibers can have a length of, for example, 1½"-2" and are properly oriented to carry the load. Generally, the fibers are oriented so their longitudinal axes are substantially parallel. Encapsulating filaments 19 is a supporting matrix of chopped glass fibers and resin. Fiberglass filaments 19 within joiner panel 14 act like staples reaching from an opening 17 in one section 12 into the associated opening 17 at the same vertical level in the other section and transferring the stress from one side panel section 12 to another adjacent side panel section 12. As already mentioned, protrusions 15 have a shape so there is a good fit of protrusion 15 within a opening 17. Protrusion 15 extends out from body 16 at least far enough to pass through the thickness of side panel section 12. Typically, this is about one-quarter inch to three-fourths inch. Filaments 19 and the encapsulating supporting matrix have sufficient strength to withstand the tension and shear forces applied by adjacent side panel sections 12. More specifically, filaments 19 extending generally parallel to the major surface of side panel section 12 have an applied tension force and filaments 19 extending generally perpendicular to the major surface of side panel section 12, i.e. those in protrusions 15, have an applied shear force.

Figure 9:
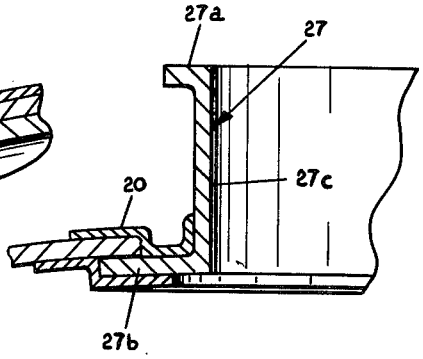
FIG. 9 is a cross section taken along section line IX—IX of FIG. 1 and shows the joint between a top section and a central manhole member.
Figure 6:
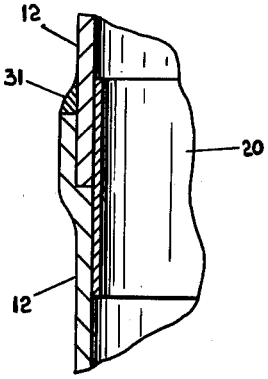
FIG. 6 is a cross section view taken along section line VI—VI of FIG. 1 showing the horizontal joint between two vertical wall sections.
Figure 6A:
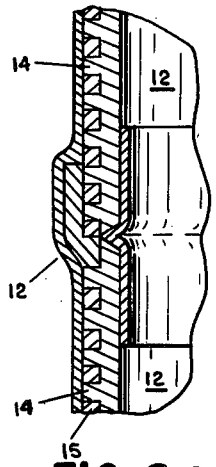
FIG. 6*a* is a cross section view taken along section line VI*a*–VI*a* of FIG. 1 showing the horizontal joint between two vertical wall sections at a joiner panel.

Each top section 11 is generally pie-shaped with the narrow end having the point removed and being concave to permit the placement of a circular manhole member 27 in the middle of the tank top (FIGS. 1 and 9). Thus, the fit between top sections 11 at the center does not have to be as critical as it would be if the points were left in. FIG. 9 shows a cross section of manhole member 27 including an upper flange **27*a*, and a lower flange 27*b* extending outward from a cylindrical body 27*c*. The narrow, concave end of top section 11 overlaps a portion of lower flange 27*b*. The curved edge of the pie-shaped section opposite the narrow end is turned downward as is shown in FIG. 7 so a downwardly bent portion 23 of top section 11 can mate with the upper portion of side panel section 12. The straight sides of adjacent top sections 11 overlap at a joint 28 when joined to form a tank top. However, an end segment of downwardly bent portion 23 is removed so there is no double thickness around bent portion 23 which would interfere with top section 11 seating in pocket 26. The vertical forces on tank 10 are primarily due to such factors as wind and thus joints sustaining such forces need not be as sturdy as those joints sustaining the hoop forces around the circumference of a filled tank. The tank top can be reinforced by elongated ribs 29 extending in spoke-like pattern at joints 28**.

The bottom section 13 is generally circular and planar and coupled to a connecting member 38 which is bent upward. Connecting member 38 includes a supporting form 39 to provide a radius and a covering layer of fabric 20 and resin. When connecting member 38 is adjacent joiner panel 14 connecting two panel sections 12, joiner panel 14 does not extend below the top of member 38 (FIG. **8*a*). As a result, the bottom portion of panel sections 12 are joined by having a joiner panel 14 exterior to tank 10. That is, the bottom portion of panel sections 12 are penetrated by protrusions 15 from the outside instead of from the inside. If desired for ease of fabrication and shipping, bottom section 13** can comprise pie-shaped sections like the tank top, two semi-circular portions or a variety of pieces combining to form a circle. Further, the bottom sections may have butt joints instead of overlapping joints.

Referring to FIGS. 5, 6, 7 and 8, the configuration of the material applied to the joints between sections 11, 12, 13 and 14 is shown. That is, a layer of adhesive mixture 31 is placed between joiner panel 14 and side panel section 12. Further, one or more layers of catalyzed filler 31 and resin coated fabric 20 or random fiber mat is placed on the outside of the joint and held in place by a resin. This layer of material serves, first, to bind the ends of protrusions 15 of joiner panel 14 that extend to the outside surface of the tank thereby holding joiner panel 14 in place, secondly, to seal the joint further should any voids between the joined sections permit fluids to pass this far, and, thirdly, to seal the joint from the outside to stop penetration of any fluids from the outside.

Figure 10:
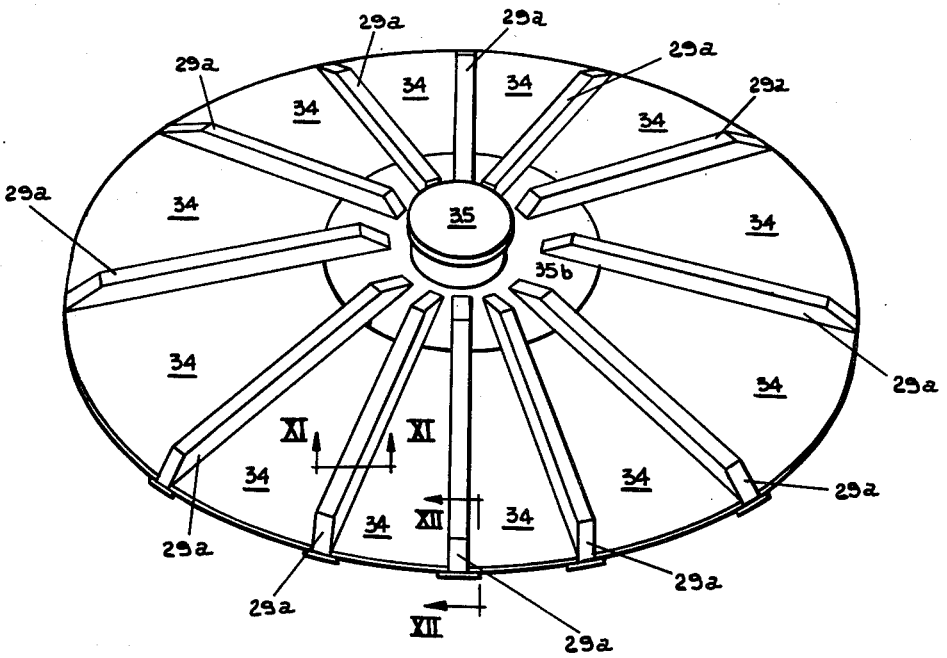
FIG. 10 is a front perspective view of a portion of a tank roof of increased strength in accordance with an embodiment of this invention.

Referring to FIG. 10, larger tanks and those tanks which experience a snow load on the roof advantageously use enlarged ribs **29*a* having elongated bodies with an inverted, generally U-shaped cross sections. Flanges 33 extend outwardly from the bottom portion of the U-shaped rib 29*a* (see FIG. 11). Roof panels 34 have a generally planar, truncated pie-shaped so when panels 34 are assembled spoke-like and ribs 29*a* are located between adjacent roof panels 34 there is formed a generally circular roof. As can be seen from FIG. 10, ribs 29*a* are longer in a radial direction than roof panels 34 and overlap a manhole member 35 which is similar to manhole member 27 except that a bottom flange 35*b* is greatly enlarged in comparison to flange 27*b* and extends beneath a portion of enlarged rib 29*a* and the inner periphery of roof panels 34**.

Figure 11:
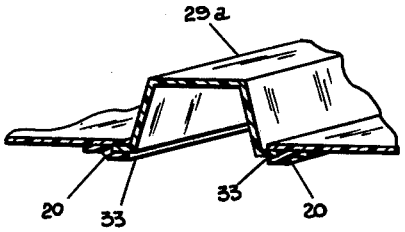
FIG. 11 is a cross section view taken along section line XI—XI of FIG. 10 showing the joint between the the ribs of the roof and the intervening panels of the roof.
Figure 12:
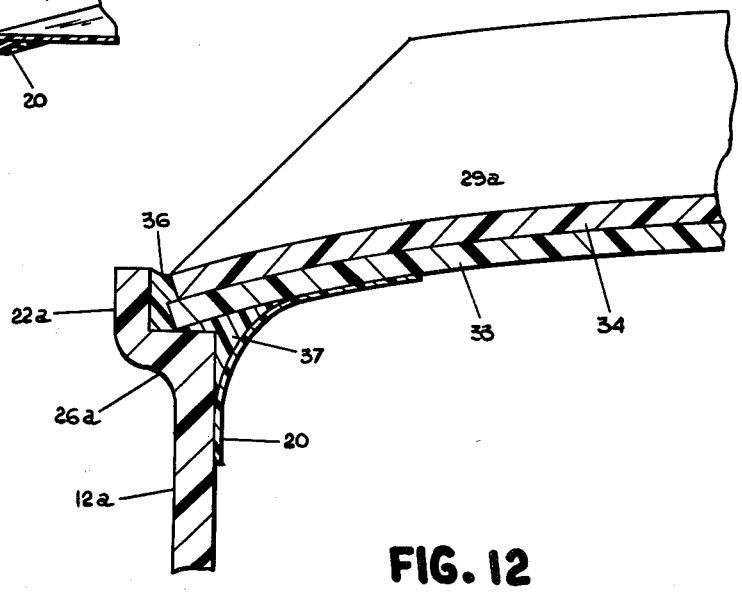
FIG. 12 is a cross section view taken along section line XII—XII of FIG. 10 and an adjoining wall section.

Referring to FIG. 11, flanges 33 extend beneath the radial edges of roof panels 34 and the junction is encapsulated in a resin and fabric 20. The outside circumferential edges of joined roof panels 34 and ribs **29*a* set within a pocket 26*a* of a side panel section 12*a*, similar to section 12. Advantageously, a pocket 26*a* is enlarged from pocket 26 of the embodiment shown in FIG. 1 wherein top section 11 has a downwardly bent portion 23. As shown in FIG. 12, any open space between a ridge 22*a*, similar to ridge 22, and the edge of ribs 29*a* and panels 34 is filled with a resin 36. The inside wall of side panel section 12 and the underneath portion of rib 29*a* and roof panel 34 is joined by a curved fabric 20 extending around the junction of the roof of the tank to the side of the tank. Typically, a resin and a filler material 37 bind fabric 20 to side panel section 12*a* and roof panels 34**.

FABRICATION

A tank in accordance with an embodiment of this invention can be prepared from high quality prefabricated components built in a shop, easily transported to the point of use and reassembled into a tank having an advantageously good ability to withstand the hoop stresses created by filling the tank.

A mandrel (not shown) is used for winding a fiberglass filament within a binding matrix which is formed as a layer on the mandrel. The mandrel is an elongated drum having, for example, four longitudinal sides, each side having a radius of curvature corresponding to the radius of curvature of side panel section 12 of tank 10 as illustrated by the outline 21 schematically illustrated on FIG. 3. When a sufficiently thick layer of material has been formed on the mandrel, the material is cured and then the object thus formed is cut apart at the intersections of the four curved longitudinal faces of the mandrel. The winding of the filaments on the mandrel for forming side panel section 12 is done helically to achieve the criss-cross pattern shown in FIG. 4 which adds to the strength of panel section 12. Once side panel sections 12 are removed from the mandrel, openings 17 can be milled or punched out. Advantageously, one end of mandrel has a raised circumferential bell so side panel section 12 can have ridge 22 formed to define pocket 26 which receives the bottom portion of top section 11 as shown in FIG. 7. Also, as was noted, if a plurality of side panel sections 12 are to be vertically placed upon one another to form a side of tank 10, pocket 26 acts to receive the bottom portion of side panel section 12.

Joiner panel 14 is molded in the shape shown and described and has the continuous filament and/or geometrically oriented glass fibers 19 placed into a hook-shape and supported in a matrix of resin and other random fibers so as to provide a high strength path for stress to be transferred between panel sections 12. Joiner panel 14 is placed inside the tank with the protrusions extending outwardly through the wall of side panel section 12 so the smoothest, and most sanitary, surface will be on the inside of the tank. However, this could be reversed and the protrusions of joiner panel 14 extend inwardly. An adhesive layer 31 is applied to the surface of joiner panel 14 facing panel sections 12. Additionally, after joiner panel 14 is in place, a fiberglass mat 20 is applied to the joint and held in place with resin. Joiner panel 14 can alternatively be held in place mechanically and the joint sealed by placing a layer of tank wall material or other material over the edges. The resin used to adhere the fiber can be the same resin used to construct the tank.

Top sections 11 are molded of a matrix of resin and random fibers. Top sections 11 are assembled by placing them together in a spoke-like arrangement so the sides going from the curved portion to the truncated point overlap somewhat. As already noted, in one embodiment it is desirable that the upper portion of top section 11 overlap the other upper portion of top section 11 to facilitate sealing of the joint and it is not desirable that the downwardly bent portion 23 overlap with another such downwardly portion adjacent top section 11 to facilitate coupling to pocket 26. Bent portion 23 is formed so the entire perimeter of joined top sections 11 has only a single thickness and ridge 22 can abut the entire perimeter of portions 23 of top sections 11. If ribs 29 are included in the construction of tank 10, the ribs are molded of a fiberglass and resin matrix and connected to top sections 11 at joints 28 by such means as, for example, bolts or an adhesive, generally the resin of tank construction, and glass fabric.

Bottom section 13 is also molded of a material similar to that of top section 11 and contains overlapping joints if section 13 includes more than one piece. Or, as already noted, the bottom sections may have but joints. The perimeter of bottom section 13 can be bent up to form an upward flange at outer peripheral portion 30 which abuts the bottom portion of side panel section 12. Alternatively, as shown in FIGS. 8 and 8*a*, the periphery of bottom section 13 can be flat and a curved, elongated connecting member 38 formed to seal the joint between bottom section 13 and panel 14. More specifically, supporting form 39, made of a material such as cardboard, provides a base upon which is applied a fiberglass mat fabric held in place with resin. The fabric extends beyond form 39 and connects to bottom section 13 and panel 14.

Examples of the material chosen for bonding the fiberglass filaments include Dow "DERAKANE" (a vinyl ester) ICI "ATLAC" (a bisphenol ester), general purpose polyester, or one of several epoxies. At the joints between the various sections of tank 10, a material is chosen which most nearly matches the chemistry of the materials used in the tank walls and the joining strip. An example in accordance with an embodiment of this invention is a catalyzed polyester resin mixed with a thixotrope. However, any adhesive compatible with tank walls and the product to be placed in the tank can be used.

Various other modifications and variations will no doubt occur to those skilled in the art to which this invention pertains. For example, the joint between the top sections and the side sections can also include rows of parallel holes with joiner panels having protrusions connecting the holes. This may be particularly useful if additional longitudinal strength is required. The method of forming the holes in the side panels may also be varied from that disclosed above. Although the above embodiment is described using fibers of glass, this invention includes use of fibers of other materials such as, for example, polypropylene and graphite. These and all other variations basically rely on the teaching through which this disclosure has advanced the art are properly considered within the scope of this invention as defined by the appended claims.

The embodiments of the invention in which an exclusive property or privilege is claimed are defined as follows.

1. A method of fabricating a fiber tank including:

forming a plurality of arcuate perimeter wall sections with coupling openings spaced along the edges thereof;

forming a joiner panel for connecting said wall sections to form the circumference of said tank; said forming of said joiner panel including forming an elongated body with two columns of transversely paired spaced protrusions longitudinally spaced along said body, positioning a plurality of reinforcing filaments within the body of said joiner panel and between said protrusions, curving said plurality of filaments into said protrusions and extending said plurality of filaments longitudinally along said protrusions while providing a resin matrix for said filaments between and along said protrusions, thus providing a plurality of filaments of generally U-shape for coupling stress applied to one protrusion to the other protrusion of the pair of protrusions; and coupling said wall sections together to define the tank wall perimeter by coupling the protrusions of said joiner panels within the openings of adjacent wall sections.

2. A method as recited in claim 1 wherein forming said wall sections includes the steps of:

forming a layer of a resin material on a mandrel having curved portions with the same curvature as the curvature of the tank perimeter;

helically winding fiber filaments around said mandrel;

dividing the material wound on the mandrel into wall sections having a curvature the same as the curvature of the perimeter of said tank; and forming openings along an edge of said wall sections for receiving the protrusions of the joiner panel.

3. A method as recited in claim 2 wherein forming said wall sections includes the steps of:

forming an offset flange along the top of said wall section to form a female bell socket for receiving an arcuate edge of a tank component.

4. A method of fabricating a fiber tank as recited in claim 3 further comprising:

molding pie-shaped top sections having a truncated narrow portion; and molding bottom sections which combine to form a circular bottom.

5. A method of fabricating a fiber tank as recited in claim 4 further comprising:

assembling elongated ribs in a spoke pattern to form a reinforcing structure for the tank top;

connecting said top sections to said ribs to form a top;

applying a catalyzed filler to the joint between said top sections and said ribs positioned between adjacent top sections;

applying an adhesive to said protrusions of said joiner panel;

joining a plurality of said wall sections by said joiner panels to form the wall of the tank;

positioning the arcuate peripheral portions of said top sections within said bell socket of said wall sections;

applying a catalyzed filler, a fiber fabric and resin to the joint between said wall sections and said top sections;

joining said bottom sections to form a tank bottom;

positioning the bottom edge of said wall sections around the periphery of said bottom sections; and applying catalyzed filler and a connecting section to the joint between said wall sections and said bottom sections.

6. A method of fabricating a fiber tank as recited in claim 5 wherein the step of joining a plurality of said wall sections by said joiner panels includes the steps of:

projecting said protrusions outwardly through said openings in said wall sections above the top of said connecting section; and projecting said protrusions inwardly through said openings in said wall sections below the top of said connecting section.

* * * * *